US010932518B2

(12) United States Patent
Matsui et al.

(10) Patent No.: US 10,932,518 B2
(45) Date of Patent: Mar. 2, 2021

(54) SOLE STRUCTURE AND SHOE INCLUDING SAME

(71) Applicant: MIZUNO CORPORATION, Osaka (JP)

(72) Inventors: Shogo Matsui, Osaka (JP); Kazunori Iuchi, Osaka (JP); Natsuki Sato, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 63 days.

(21) Appl. No.: 16/357,386

(22) Filed: Mar. 19, 2019

(65) Prior Publication Data

US 2019/0289959 A1 Sep. 26, 2019

(30) Foreign Application Priority Data

Mar. 20, 2018 (JP) ..... JP2018-052913

(51) Int. Cl.

| | |
|---|---|
| ***A43B 13/18*** | (2006.01) |
| ***A43B 13/12*** | (2006.01) |
| ***A43B 13/14*** | (2006.01) |
| ***A43B 13/38*** | (2006.01) |
| ***A43B 21/26*** | (2006.01) |
| ***A43B 21/32*** | (2006.01) |

(52) U.S. Cl.

CPC ..... *A43B 13/12* (2013.01); *A43B 13/14* (2013.01); *A43B 13/185* (2013.01); *A43B 13/386* (2013.01); *A43B 21/26* (2013.01); *A43B 21/32* (2013.01)

(58) Field of Classification Search

CPC ..... A43B 13/00; A43B 13/18; A43B 13/181; A43B 13/184; A43B 13/185; A43B 13/206; A43B 21/26; A43B 21/32

USPC ..... 36/28, 35 R, 37

See application file for complete search history.

(56) References Cited

U.S. PATENT DOCUMENTS

| | | | | |
|---|---|---|---|---|
| 7,484,317 | B2 * | 2/2009 | Kita | A43B 13/10 36/27 |
| 7,513,065 | B2 * | 4/2009 | Kita | A43B 13/12 36/27 |
| 7,730,635 | B2 * | 6/2010 | Aveni | A43B 13/183 36/27 |
| 7,886,461 | B2 * | 2/2011 | Sato | A43B 13/16 36/27 |

(Continued)

FOREIGN PATENT DOCUMENTS

| | | | |
|---|---|---|---|
| JP | 3014660 | U | 8/1995 |
| JP | 4452720 | B2 | 2/2010 |

(Continued)

OTHER PUBLICATIONS

Japanese Notice of Reasons for Refusal issued in application No. JP2018-052913 dated Dec. 25, 2019.

*Primary Examiner* — Marie D Bays

(74) *Attorney, Agent, or Firm* — Troutman Pepper Hamilton Sanders LLP; James E. Schutz; Micah B. Hensley

(57) ABSTRACT

A support is configured such that a bulge is allowed to deform toward a deformation space due to the deformation space when the deformation space is in an open state, and that the bulge is allowed to deform upward and a buffer member is compressively deformed when the deformation space is in a closed state.

4 Claims, 6 Drawing Sheets

(56) References Cited

U.S. PATENT DOCUMENTS

| | | | | |
|---|---|---|---|---|
| 8,181,360 | B2 * | 5/2012 | Kita | A43B 13/181 36/25 R |
| 8,567,093 | B2 * | 10/2013 | Sato | A43B 7/143 36/27 |
| 2006/0283045 | A1 * | 12/2006 | Kita | A43B 13/141 36/28 |
| 2007/0113425 | A1 * | 5/2007 | Wakley | A43B 13/20 36/28 |
| 2007/0193065 | A1 | 8/2007 | Nishiwaki et al. | |
| 2008/0034615 | A1 * | 2/2008 | Nishiwaki | A43B 13/20 36/88 |
| 2008/0289224 | A1 * | 11/2008 | Sink | A43B 13/181 36/103 |
| 2009/0126224 | A1 * | 5/2009 | Greene | A43B 7/32 36/27 |
| 2009/0241377 | A1 * | 10/2009 | Kita | A43B 13/181 36/107 |
| 2011/0138651 | A1 | 6/2011 | Nishiwaki et al. | |
| 2011/0239489 | A1 | 10/2011 | Iuchi et al. | |
| 2011/0289799 | A1 * | 12/2011 | Keating | A43B 13/122 36/103 |

FOREIGN PATENT DOCUMENTS

| | | | |
|---|---|---|---|
| JP | WO2008156164 | A1 | 8/2010 |
| JP | 2013017604 | A | 1/2013 |
| JP | WO2011125959 | A1 | 7/2013 |

* cited by examiner

SOLE STRUCTURE AND SHOE INCLUDING SAME

CROSS-REFERENCE TO RELATED APPLICATION

This application claims priority to Japanese Patent Application No. 2018-052913 filed on Mar. 20, 2018, the entire disclosure of which is incorporated by reference herein.

BACKGROUND

The present disclosure relates to a sole structure and a shoe including the sole structure.

A shoe sole structure as disclosed in, for example, Japanese Patent No. 4452720 has been known.

The shoe sole structure disclosed in Japanese Patent No. 4452720 includes a deformation element provided between an outsole and a midsole, and disposed so as to correspond to the hindfoot a wearer's foot. The deformation element includes a tubular portion including an internal space formed through the tubular portion in the foot width direction, and a buffer member provided at a position substantially at the middle of the internal space in the longitudinal direction. The tubular portion is configured to have a higher Young's modulus than the buffer member.

SUMMARY

When a wearer wearing a shoe steps on the ground (hereinafter referred to as the moment of touching the ground) while running or walking, for example, a strong impact (an external force) from the ground is likely to act on the foot of the wearer. Hence, a sole structure for a shoe is required to provide a degree of cushioning that is high enough to cushion such a strong impact.

In the sole structure of Japanese Patent No. 4452720, the buffer member is fixed such that an upper end and a lower end of the buffer member are respectively in contact with an upper portion and a lower portion of the tubular portion. Therefore, when an external force acts on the sole structure, the elastic deformation of the tubular portion and the compression deformation of the buffer member simultaneously occur. It is therefore presumed that the sole structure of Japanese Patent No. 4452720 provides a degree of cushioning by elastically deforming the tubular portion having a relatively high Young's modulus and by compressively deforming the buffer member having a relatively low Young's modulus.

However, in the sole structure of Japanese Patent No. 4452720, the tubular portion and the buffer member deform simultaneously whenever an external force acts on the sole structure, regardless of the magnitude of the external force. Such deformation makes it difficult for the deformation element to deform. Therefore, the sole structure might not be able to cushion, in particular, the impact applied at the moment of touching the ground.

In view of the foregoing background, the present disclosure intends to enable gradual change of a degree of cushioning depending on a state in which a sole structure touches the ground.

Specifically, a first aspect of the present disclosure is directed to a sole structure for a shoe. The sole structure includes a sole body. A support is provided to the sole body. The support includes: an upper plate configured to support a foot of a wearer; a lower plate provided below the upper plate; and a buffer member which is elastically deformable, provided between the upper plate and the lower plate, and has a lower Young's modulus than the upper plate and the lower plate. The lower plate includes a bulge which is elastically deformable, and a bottom of which protrudes downward. The buffer member includes a deformation space provided above the bulge and extending through the buffer member in a direction perpendicular to a thickness direction of the sole body, the deformation space being a hollow or in a shape of a recess. The support is configured such that the bulge is allowed to elastically deform toward the deformation space due to the deformation space when the deformation space is in an open state, and that the bulge is allowed to elastically deform upward and the buffer member is compressively deformed when the deformation space is in a closed state.

In the first aspect, the support is configured such that the bulge is allowed to deform toward the deformation space when the deformation space is in the open state. Thus, at a moment of touching the ground and immediately after the moment, the deformation space is in the open state. The deformation space being in the open state reduces compressive deformation of the buffer member and allows the bulge of the lower plate to elastically deform toward the deformation space. In other words, at the moment of touching the ground and immediately after the moment, the elastic deformation of the bulge of the lower plate causes a high degree of cushioning to be provided. On the other hand, when a strong external force is continuously acting on the sole structure even after the moment of touching the ground, the bulge of the lower plate elastically deforms so that the deformation space is displaced to be brought into a closed state. Then, if the strong external force continues acting on the sole structure with the deformation space being in the closed state, the bulge of the lower plate elastically deforms upward while the buffer member is compressively deformed. As a result, the elastic deformation of the bulge and the compressive deformation of the buffer member cause a degree of cushioning to be provided. As described above, the degree of cushioning of the sole structure gradually changes as the magnitude of the external force acting on the sole structure changes over time from the moment of touching the ground. As a result, in the first aspect, the degree of cushioning can be gradually changed depending on, in particular, a state in which the sole structure touches the ground.

A second aspect of the present disclosure is an embodiment of the first aspect. In the second aspect, the support is provided in a heel area configured to support a heel of the wearer, and the buffer member is disposed to extend along an outer peripheral edge of the heel area.

In the second aspect, the outer peripheral edge of the heel area is an area on which an external force acts intensely at the moment of touching the ground. Thus, the buffer member is disposed in the area on which the external force F acts intensely at the moment of touching the ground.

A third aspect of the present disclosure is an embodiment of the first aspect. In the third aspect, the upper plate includes a lifting portion formed at each of both ends of the upper plate in the foot width direction, and extending upward.

The third aspect can reduce the movement of the wearer's foot in the foot width direction. Such a feature can make the wearer feel the foot held more properly.

A fourth aspect of the present disclosure is an embodiment of the first aspect. In the fourth aspect, the bulge includes a plurality of bulges, and the lower plate has a corrugated shape due to the bulges.

In the fourth aspect, the bulge includes a plurality of bulges. Such a feature can further increase a degree of cushioning of the sole structure.

A fifth aspect of the present disclosure is directed to a shoe including the sole structure according to any one of the first to fourth aspects.

According the fifth aspect, the degree of cushioning can be gradually changed depending on, in particular, a state in which the shoe touches the ground.

As can be seen from the foregoing description, the present disclosure can gradually change the degree of cushioning depending on, in particular, a state in which the sole structure touches the ground.

DETAILED DESCRIPTION

Embodiments of the present disclosure will now be described in detail with reference to the drawings. Note that the following description of the embodiments is a mere example in nature, and is not intended to limit the scope, application, or uses of the present disclosure.

First Embodiment

Figure 1:
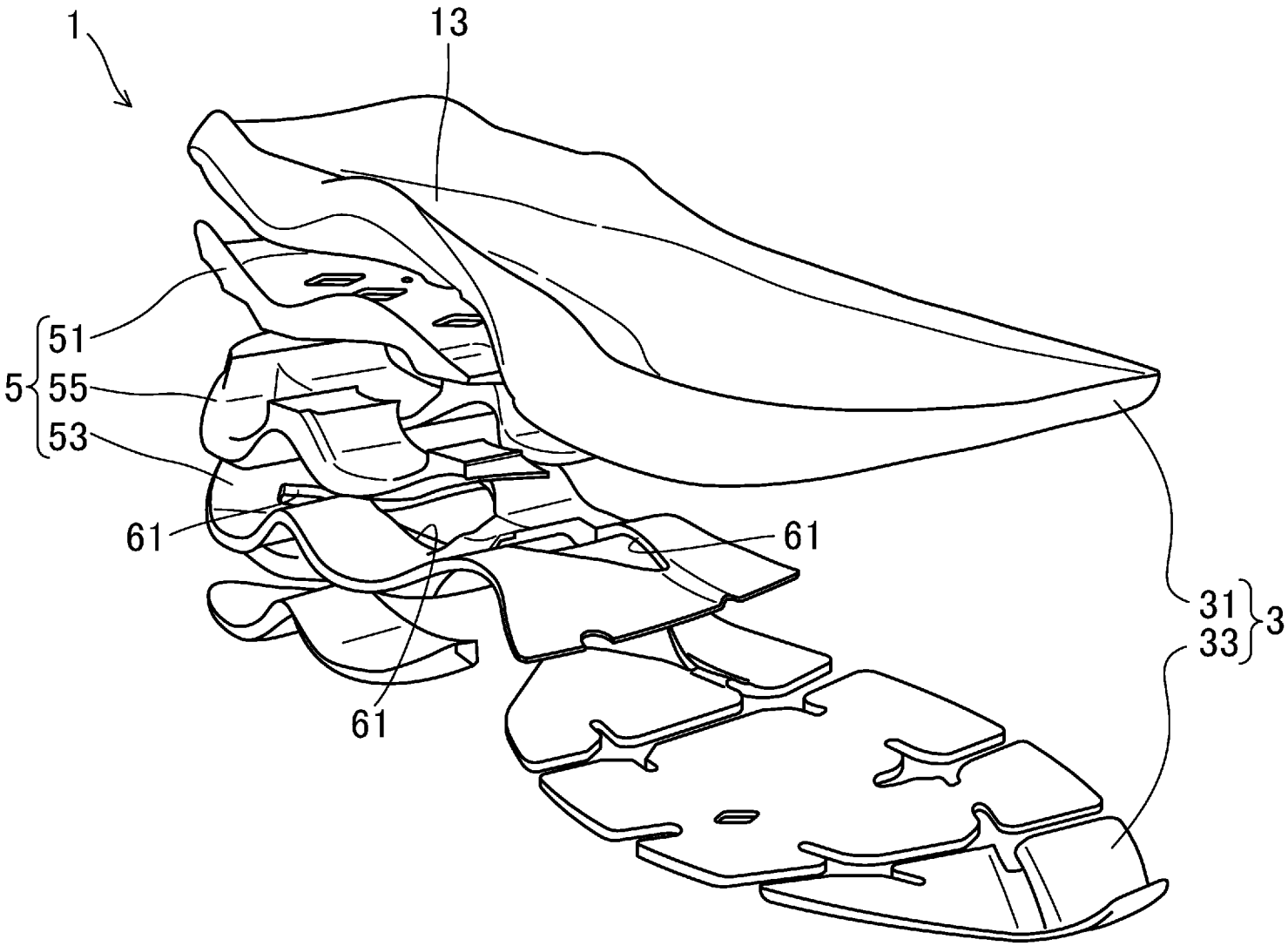
FIG. 1 is an exploded perspective view of a sole structure according to a first embodiment of the present disclosure.
Figure 2:
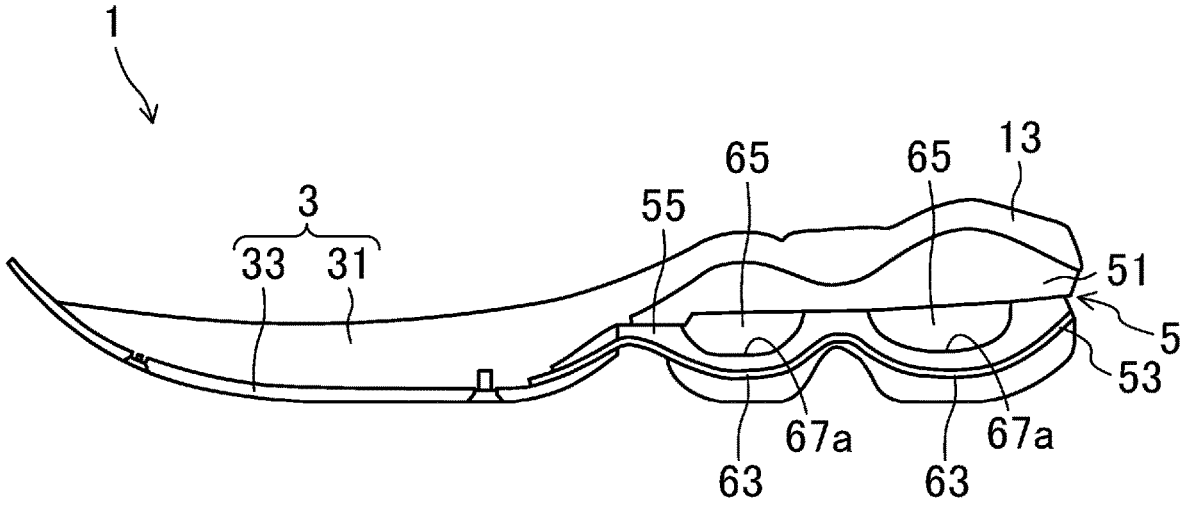
FIG. 2 is a side view of the sole structure, as viewed from a medial side.
Figure 3:
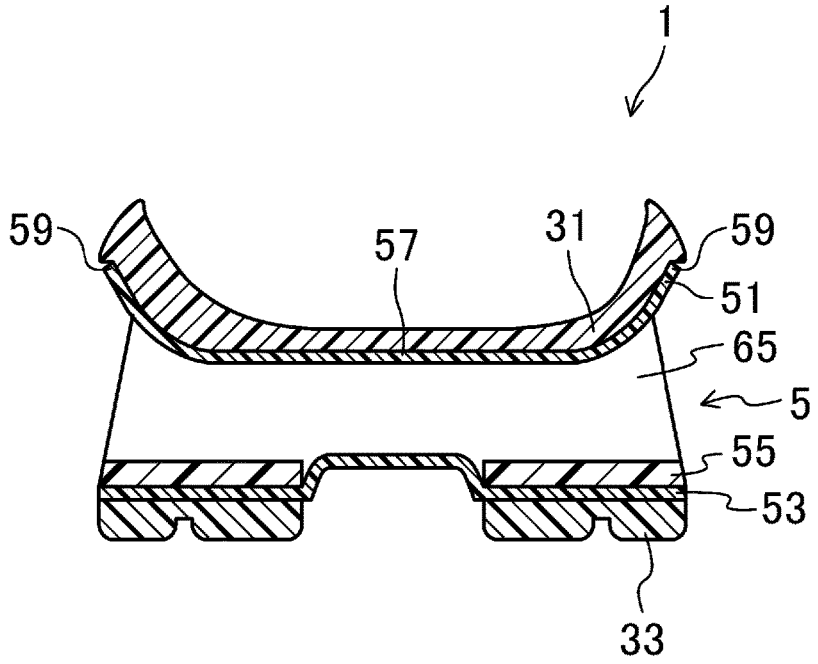
FIG. 3 is a cross-sectional view taken along line in FIG. 2.

FIGS. 1 to 3 illustrate an overall structure of a sole structure 1 according to a first embodiment of the present disclosure. The sole structure 1 is intended to support the plantar surface of a foot of a wearer. A pair of shoes including the sole structure 1, a shoe upper (not shown) provided on the sole structure 1, and other components are usable as, for example, running shoes, walking shoes, shoes for indoor sports, and shoes for ball sports played on soil or turf.

The drawings show the sole structure 1 for a left shoe only. A sole structure for a right shoe is symmetrical to the sole structure 1 for the left shoe. In the following description, only the sole structure 1 for the left shoe will be described and the description of the sole structure for the right shoe will be omitted.

In the following description, the expressions "above," "upward," "on a/the top of," "below," "under," and "downward," represent the vertical positional relationship between components of the sole structure 1. The expressions "front," "fore," "forward, "rear," "back," "hind," "behind," and "backward" represent the positional relationship in the longitudinal direction between components of the sole structure 1.

As illustrated in FIGS. 1 to 3, the sole structure 1 includes a sole body 3 and a support 5.

(Sole Body)

The sole body 3 includes a midsole 31 configured to receive and support the entire plantar surface extending from a forefoot to a hindfoot, and outsoles 33, 33 . . . stacked below the midsole 31.

The midsole 31 is made of a soft elastic material. Examples of the material suitable for the midsole 31 include, but are not limited to, thermoplastic synthetic resins such as ethylene-vinyl acetate copolymer (EVA) and foams of the thermoplastic synthetic resins, thermosetting resins such as polyurethane (PU) and foams of the thermosetting resins, and rubber materials such as butadiene rubber and chloroprene rubber and foams of the rubber materials.

In an upper portion of the midsole 31, a planta support surface configured to support the plantar surface extends in the longitudinal direction. A shoe upper (not shown) for covering the wearer's foot is attached to a peripheral portion of the midsole 31.

The outsoles 33, 33, . . . are arranged over an area corresponding to a region extending from the forefoot to the hindfoot of the wearer's foot. In a rear portion of the sole structure 1 where the support 5 is disposed, the outsoles 33, 33, . . . are provided on the lower surface of a lower plate 53, which will be described later. In a front portion of the sole structure 1 where the support 5 is not disposed, the outsoles 33, 33, . . . are provided on the lower surface of the midsole 31.

The outsoles 33, 33, . . . are made of a hard elastic material which is harder than the material for the midsole 31. Examples of the material suitable for the outsoles 33 include, but not are limited to, thermoplastic resins such as ethylene-vinyl acetate copolymer (EVA), thermosetting resins such as polyurethane (PU), and rubber materials such as butadiene rubber and chloroprene rubber.

The lower surfaces of the outsoles 33, 33, . . . are configured to function as a main ground surface at a moment when the sole structure 1 touches the ground (at the moment of touching the ground) during wearer's running or walking.

(Support)

The support 5 is provided between the midsole 31 and the outsoles 33, 33, . . . of the sole body 3. The support 5 is arranged in a rear portion of the sole structure 1 that includes a heel area 13 configured to support a heel of the wearer. The support 5 deforms at the moment of touching the ground to cause the sole structure 1 to provide a degree of cushioning. The support 5 has an upper plate 51, a buffer member 55, and a lower plate 53 in this order from the top.

(Upper Plate)

The upper plate 51 is provided on the lower surface of the midsole 31, and configured to support the wearer's foot. The upper plate 51 is comprised of a plate that is elastically deformable and harder and thinner than the buffer member 55. The upper plate 51 preferably has a Young's modulus of, for example, 5 MPa or higher and 1000 MPa or lower. The upper plate 51 is made of, for example, a thermoplastic resin such as thermoplastic polyurethane (TPU), polyamide elastomer (PAE), and ABS, or a thermosetting resin such as epoxy resin and unsaturated polyester resin. Alternatively, the upper plate 51 may be made of a fiber-reinforced resin containing carbon fibers or metal fibers.

As shown in FIG. 3, the upper plate 51 has a U-shape in cross section. Specifically, the upper plate 51 has a plate-like body 57 and lifting portions 59, 59 extending upward from both ends, of the body 57, in the foot width direction.

(Lower Plate)

The lower plate 53 is provided under the buffer member 55 and on top of the outsoles 33, 33 . . . . The lower plate 53 is comprised of a plate that is elastically deformable and harder and thinner than the buffer member 55. The lower plate 53 preferably has a Young's modulus of, for example, 5 MPa or higher and 1000 MPa or lower. The lower plate 53 is made of, for example, a thermoplastic resin such as thermoplastic polyurethane (TPU), polyamide elastomer (PAE), and ABS, or a thermosetting resin such as epoxy resin and unsaturated polyester resin. Alternatively, the lower plate 53 may be made of a fiber-reinforced resin containing carbon fibers or metal fibers.

The lower plate 53 extends in the longitudinal direction to constitute the lower surface of the support 5. The lower plate 53 has a plurality of lightening holes 61, 61, . . . formed in a middle portion of the lower plate 53 in the foot width direction. The lower plate 53 has two bulges 63, 63 having a bottom protruding downward, and arranged in the longitudinal direction. Due to the bulges 63, 63, the lower plate 53 has a corrugated shape having peaks and valleys alternating with each other in the longitudinal direction. The bulges 63, 63, which protrude downward, are likely to receive an external force from, for example, the ground at the moment of touching the ground.

(Buffer Member)

The buffer member 55 is provided between the upper plate 51 and the lower plate 53. The buffer member 55 is disposed to extend along an outer peripheral edge of a heel area 13. The buffer member 55 is elastically deformable. The buffer member 55 has a lower Young's modulus and is more easily deformed than the upper plate 51 and the lower plate 53. Specifically, the Young's modulus of the buffer member 55 is preferably, for example, 0.1 MPa or higher and 3 MPa or lower. The buffer member 55 is made of, for example, an elastic material with low resilience. Examples of the material for the buffer member 55 include, but are not limited to, thermoplastic synthetic resins such as ethylene-vinyl acetate copolymer (EVA) and foams thereof, thermosetting resins such as polyurethane (PU) and foams thereof, and rubber materials such as butadiene rubber and chloroprene rubber and foams thereof.

The buffer member 55 has deformation spaces 65, 65 that are each provided in the form of a recess. The deformation spaces 65, 65 are located above the bulges 63, 63 and extend through the buffer member 55 in the foot width direction. Specifically, the deformation spaces 65, 65 are formed by recessing the upper surface of the buffer member 55 downward, and extend in the foot width direction. The deformation spaces 65, 65 are located between the upper plate 51 and lower walls 67*a*, 67*a* that are provided in portions of the upper surface of the buffer member 55 and correspond to the bulges 63, 63. Portions, of the upper surface of the buffer member 55, in which the deformation spaces 65, 65 are not provided are bonded to the upper plate 51. On the other hand, the lower surface of the buffer member 55 is bonded to the lower plate 53.

(Operation of Support)

Figure 4:
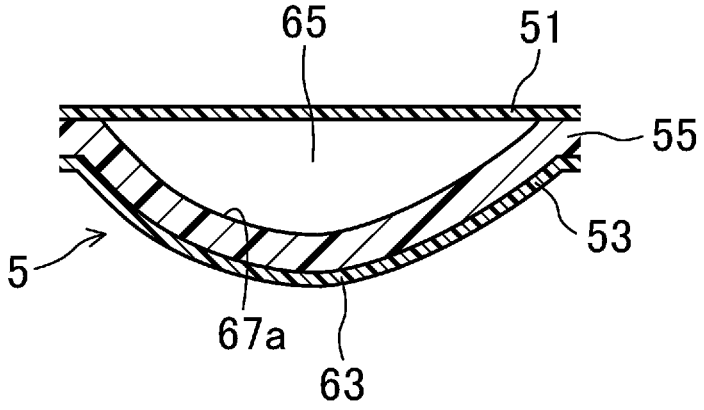
FIG. 4 is a cross-sectional view schematically illustrating a deformation space before a moment of touching the ground.
Figure 5:
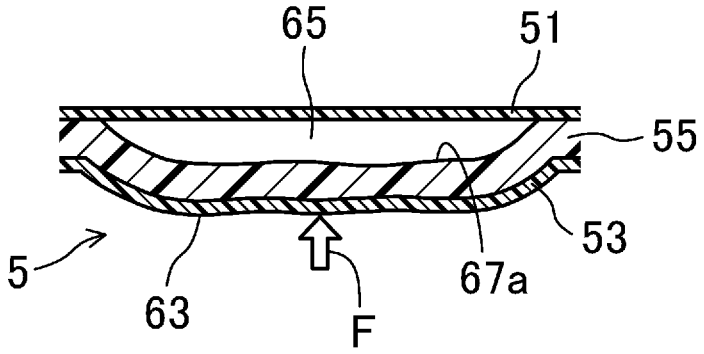
FIG. 5 corresponds to FIG. 4, and illustrates a state immediately after the moment of touching the ground.
Figure 6:
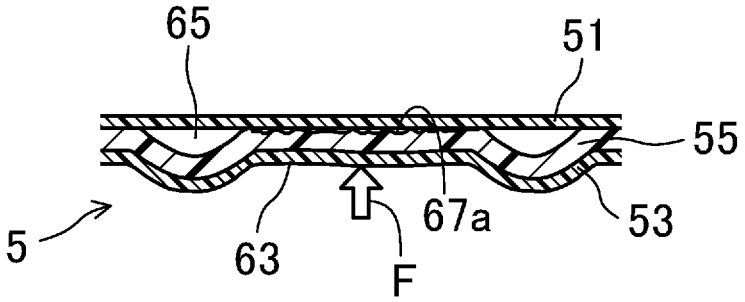
FIG. 6 corresponds to FIG. 4, and illustrates a state where a buffer member has deformed.

FIGS. 4 to 6 illustrate a state in which no external force acts on the support 5, and how the support 5 operates when an external force F acts thereon. At the moment of touching the ground, an external force F, such as a repulsive force from, for example, the ground acts on the lower plate 53 via the outsoles 33, 33 . . . . At this moment, the bulges 63, 63 deform upward. Further, since the buffer member 55 is in contact with the lower plate 53, the lower wall 67*a*, 67*a* deform upward together with the deformation of the bulges 63, 63. Immediately after the moment of touching the ground, the deformation spaces 65, 65 of the support 5 are in an open state. In other words, the deformation spaces 65, 65 remain located above the lower walls 67*a*, 67*a* of the buffer member 55. Thus, as shown in FIG. 5, the buffer member 55 deforms within the deformation spaces 65, 65 as the lower walls 67*a*, 67*a* come near the upper plate 51, so that the deformation spaces 65, 65 are narrowed. As can be seen, when the deformation spaces 65, 65 are in the open state, the bulges 63, 63 are allowed to deform toward the deformation spaces 65, 65. When the external force F acting on the support 5 is less than a predetermined value, the bulges 63, 63 then elastically restore to the original state as the external force F acting on the support 5 decreases.

On the other hand, when the external force F acting on the support 5 is greater than or equal to the predetermined value, at least a portion of the lower walls 67*a*, 67*a* and the upper plate 51 come into contact with each other, so that the deformation spaces 65, 65 are further narrowed to be brought into a closed state while the bulges 63, 63 further deform upward. As illustrated in FIG. 6, at this time, the buffer member 55 is sandwiched between the upper plate 51 and the bulges 63, 63 to be compressively deformed. As can be seen, when the deformation spaces 65, 65 are in the closed state, the bulges 63, 63 deform upward and the buffer member 55 is compressively deformed. Then, as the external force F acting on the support 5 decreases, the bulges 63, 63 elastically restore to the original state.

Effects of First Embodiment

As described above, the support 5 is configured such that the bulges 63, 63 are allowed to deform toward the deformation spaces 65, 65 when the deformation space 65, 65 are in an open state. Thus, for example, at the moment of touching the ground and immediately after the moment, the deformation spaces 65, 65 are in the open state. The buffer member 55 is not compressively deformed, while the bulges 63, 63 of the lower plate 53 are allowed to elastically deform toward the deformation spaces 65, 65. In other words, at the moment of touching the ground and immediately after the moment, the elastic deformation of the bulges 63, 63 of the lower plate 53 causes a high degree of cushioning to be provided. On the other hand, when a strong external force F is continuously acting on the sole structure 1 even after the moment of touching the ground, the bulges 63, 63 of the lower plate 53 elastically deform so that the deformation spaces 65, 65 are displaced to be brought into a closed state. If the strong external force F continues acting on the sole structure 1 with the deformation spaces 65, 65 being in the closed state, the bulges 63, 63 of the lower plate 53 are allowed to elastically deform upward while the buffer member 55 is compressively deformed. As a result, the elastic deformation of the bulges 63, 63 and the compressive deformation of the buffer member 55 allow a degree of cushioning to be provided. At this time, the degree of the elastic deformation of the bulges 63, 63 is reduced by the compressive deformation of the buffer member 55. However, the energy of the external force F is absorbed and accumulated in the buffer member 55 such that the sole structure 1 provides a degree of cushioning. As described above, the degree of cushioning of the sole structure 1 gradually changes as the magnitude of the external force F acting on the sole structure 1 changes over time from the moment of touching the ground. As a result, in the first embodiment, the degree of cushioning can be gradually changed depending on, in particular, a state in which the sole structure touches the ground.

Further, since the deformation spaces 65, 65 extend through the buffer member 55, the lower walls 67*a*, 67*a* easily deform. Such a feature allows the bulges 63, 63 and the lower wall 67*a*, 67*a* to elastically deform easily, contributing to a further increase in the degree of cushioning immediately after the moment of touching the ground.

Moreover, the support 5 is provided in the heel area 13 that is configured to support the heel of the wearer, and the buffer member 55 is disposed to extend along the outer peripheral edge of the heel area 13. In the sole structure 1, the outer peripheral edge of the heel area 13 is an area on which an external force F acts intensely at the moment of touching the ground. Thus, the buffer member 55 is arranged in the area on which the external force F acts intensely at the moment of touching the ground.

Moreover, the upper plate 51 includes the lifting portions 59, 59 formed at the both ends thereof in the foot width direction, and extending upward. As a result, the upper plate 51 can reduce the movement of the wearer's foot in the foot width direction. Such a feature can make the wearer feel the foot held more properly.

Further, the sole structure 1 includes the plurality of bulges 63, 63, due to which the lower plate 53 has a corrugated shape. Such a feature can further increase a degree of cushioning of the sole structure 1.

First Variation of First Embodiment

Figure 7:
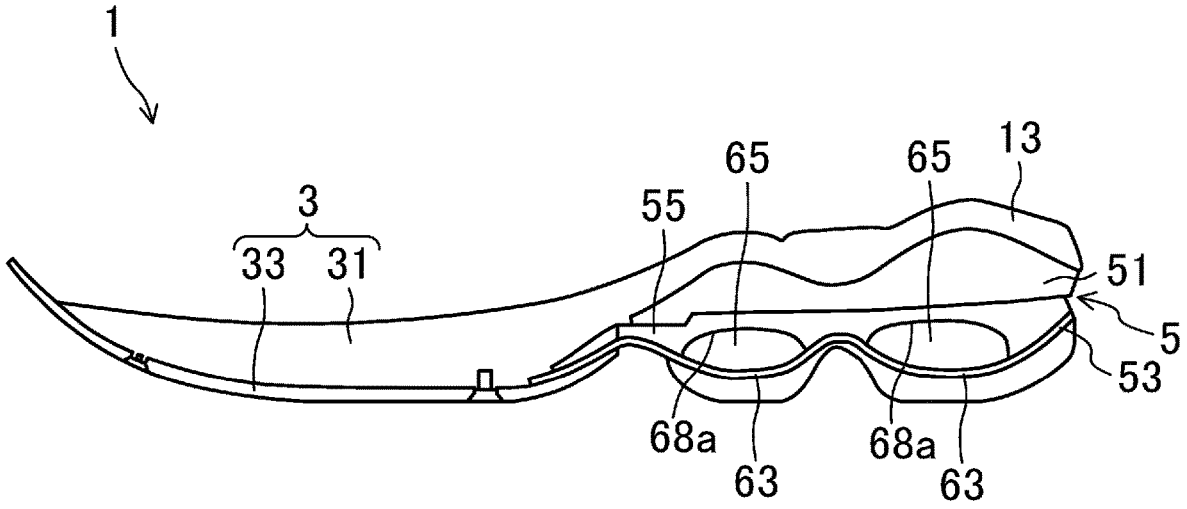
FIG. 7 corresponds to FIG. 2, and illustrates a sole structure according to a first variation of the first embodiment.

FIG. 7 illustrates a first variation of the sole structure 1 according to the first embodiment. As can be seen, the deformation spaces 65, 65 may be formed by upward recessing the lower surface of the buffer member 55, and may extend in the foot width direction.

Specifically, the deformation spaces 65, 65 are located between the lower plate 53 and upper walls 68*a*, 68*a* that are provided in portions of the lower surface of the buffer member 55 and correspond to the bulges 63, 63. Portions, of the lower surface of the buffer member 55, where the deformation spaces 65, 65 are not provided are bonded to the lower plate 53. On the other hand, the upper surface of the buffer member 55 is bonded to the upper plate 51.

In this variation, immediately after the moment of touching the ground, the buffer member 55 deforms within the deformation spaces 65, 65 as the bulges 63, 63 come near the upper walls 68*a*, 68*a*, so that the deformation spaces 65, 65 are narrowed. Thus, when the deformation space 65, 65 are in an open state, the bulges 63, 63 are allowed to deform upward due to the deformation spaces 65, 65.

On the other hand, when an external force F acting on the support 5 is greater than or equal to the predetermined value, at least a portion of the bulges 63, 63 and the upper walls 68*a*, 68*a* of the buffer member 55 come into contact with each other, so that the deformation spaces 65, 65 are further narrowed to be brought into a closed state while the bulges 63, 63 further deform upward. At this time, the buffer member 55 is sandwiched between the upper plate 51 and the bulges 63, 63 to be deformed compressively. As can be seen, when the deformation spaces 65, 65 are in the closed state, the bulges 63, 63 deform upward and the buffer member 55 is compressively deformed.

Second Variation of First Embodiment

Figure 8:
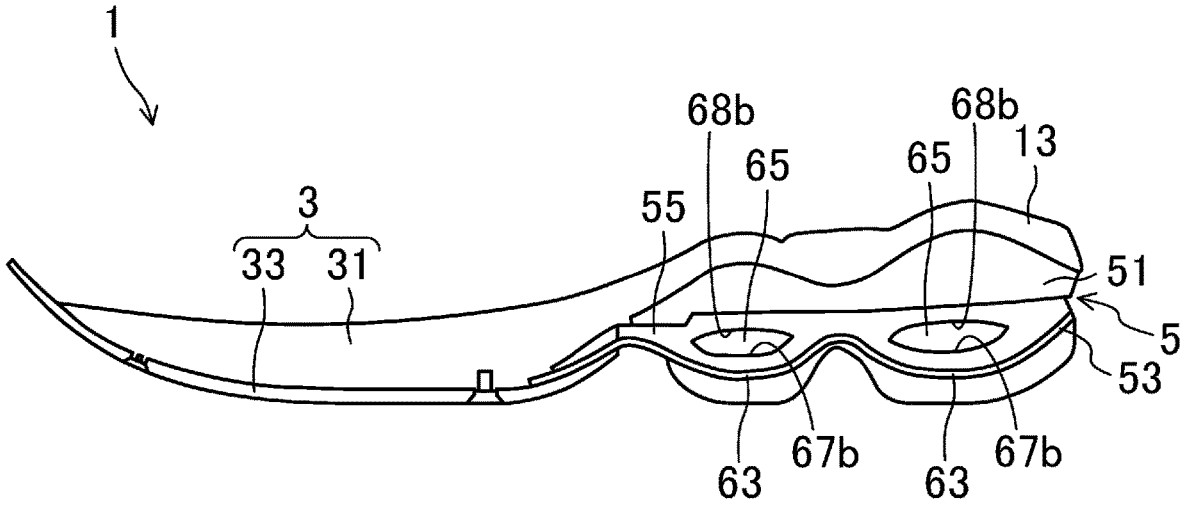
FIG. 8 corresponds to FIG. 2, and illustrates a sole structure according to a second variation of the first embodiment.

FIG. 8 illustrates a second variation of the sole structure 1 according to the first embodiment. As can be seen, the deformation spaces 65, 65 may be formed as hollows extending through the buffer member 55.

Specifically, the deformation spaces 65, 65 are located in portions, of the buffer member 55, which correspond to the bulges 63, 63. The deformation spaces 65, 65 are located between lower walls 67*b*, 67*b* and upper walls 68*b*, 68*b*. The lower walls 67*b*, 67*b* each constitute a lower portion of an inner peripheral surface of the buffer member 55, and the upper walls 68*b*, 68*b* each constitute an upper portion of the inner peripheral surface of the buffer member 55. The lower surface of the buffer member 55 is bonded to the lower plate 53. On the other hand, the upper surface of the buffer member 55 is bonded to the upper plate 51.

In this variation, immediately after the moment of touching the ground, the buffer member 55 deforms within the deformation spaces 65, 65 as the lower walls 67*b*, 67*b* come near the upper walls 68*a*, 68*a* due to upward elastic deformation of the bulges 63, 63, so that the deformation spaces 65, 65 are narrowed. Thus, when the deformation space 65, 65 are in an open state, the bulges 63, 63 are allowed to deform upward due to the deformation spaces 65, 65.

On the other hand, when an external force F acting on the support 5 is greater than or equal to a predetermined value, at least a portion of the lower walls 67*b*, 67*b* and the upper walls 68*b*, 68*b* come into contact with each other, so that the deformation spaces 65, 65 are further narrowed to be brought into a closed state while the bulges 63, 63 further deform upward. At this time, the buffer member 55 is sandwiched between the upper plate 51 and the bulges 63, 63 to be deformed compressively. As can be seen, when the deformation spaces 65, 65 are in the closed state, the bulges 63, 63 deform upward and the buffer member 55 is compressively deformed.

Third Variation of First Embodiment

Figure 9:
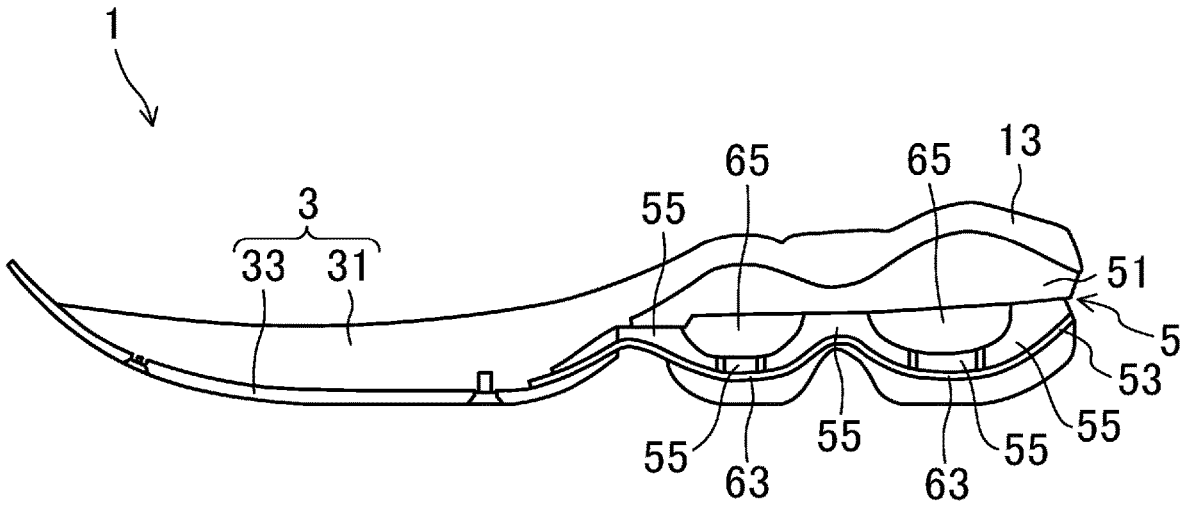
FIG. 9 corresponds to FIG. 2, and illustrates a sole structure according to a third variation of the first embodiment.

FIG. 9 illustrates a third variation of the sole structure 1 according to the first embodiment. As can be seen, the buffer member 55 may be separated into a plurality of buffer members 55, 55 . . . arranged in the longitudinal direction.

Second Embodiment

Figure 10:
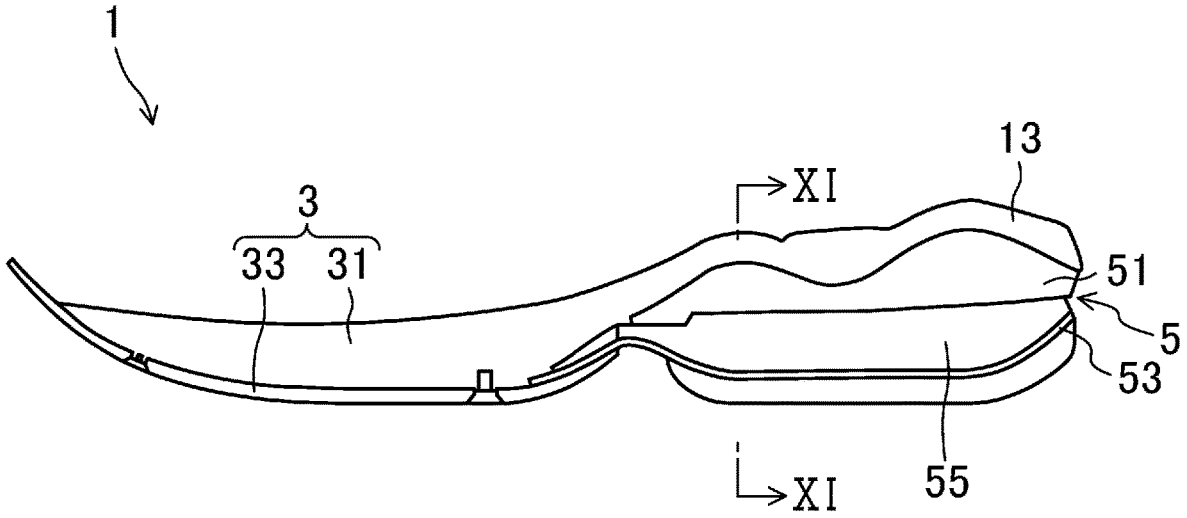
FIG. 10 corresponds to FIG. 2, and illustrates a sole structure according to a second embodiment of the present disclosure.
Figure 11:
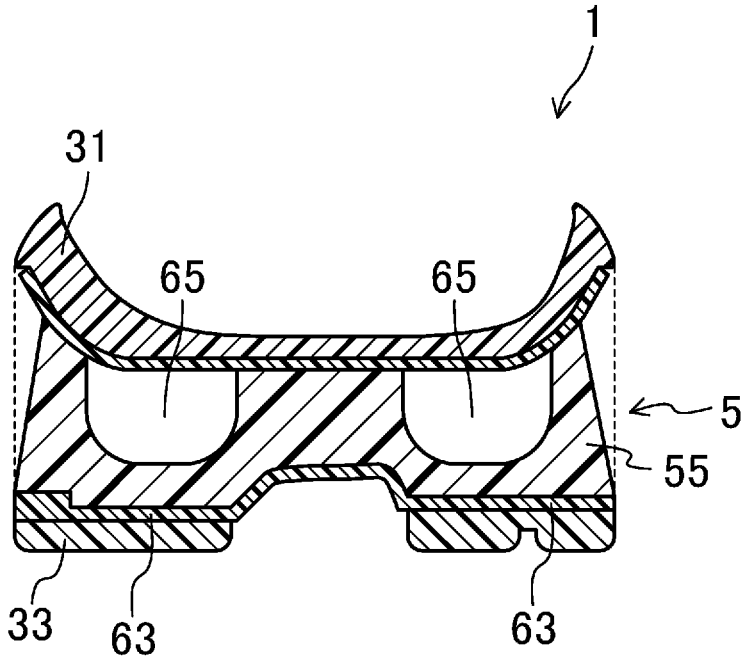
FIG. 11 is a cross-sectional view taken along line XI-XI in FIG. 10.

FIGS. 10 and 11 illustrate a sole structure 1 according to a second embodiment of the present disclosure. The second embodiment differs from the first embodiment in part of the structure of the support 5. Note that the sole structure 1 of the second embodiment is the same as the sole structure 1 of the first embodiment, except the difference. Therefore, components that are the same as those shown in FIGS. 1 to 6 are denoted by the corresponding reference characters, and a detailed description thereof is omitted herein.

A lower plate 53 of this embodiment has bulges 63, 63 provided in both end portions thereof in the foot width direction. The bulges 63, 63 extend in the longitudinal direction and have a bottom protruding downward. The deformation spaces 65, 65 of the buffer member 55 are formed by recessing the upper surface of the buffer member 55 downward, and extend in the longitudinal direction.

Thus, in the sole structure 1 of the second embodiment, the bulges 63, 63 and the deformation space 65, 65 extend in the longitudinal direction. For this reason, the support member 5 easily deform at the moment when the sole structure 1 touches the ground while moving in the foot width direction. Therefore, the sole structure 1 of the second embodiment is suitable as the sole structure of indoor sport shoes that are subjected to frequent movements in the foot width direction.

Third Embodiment

Figure 12:
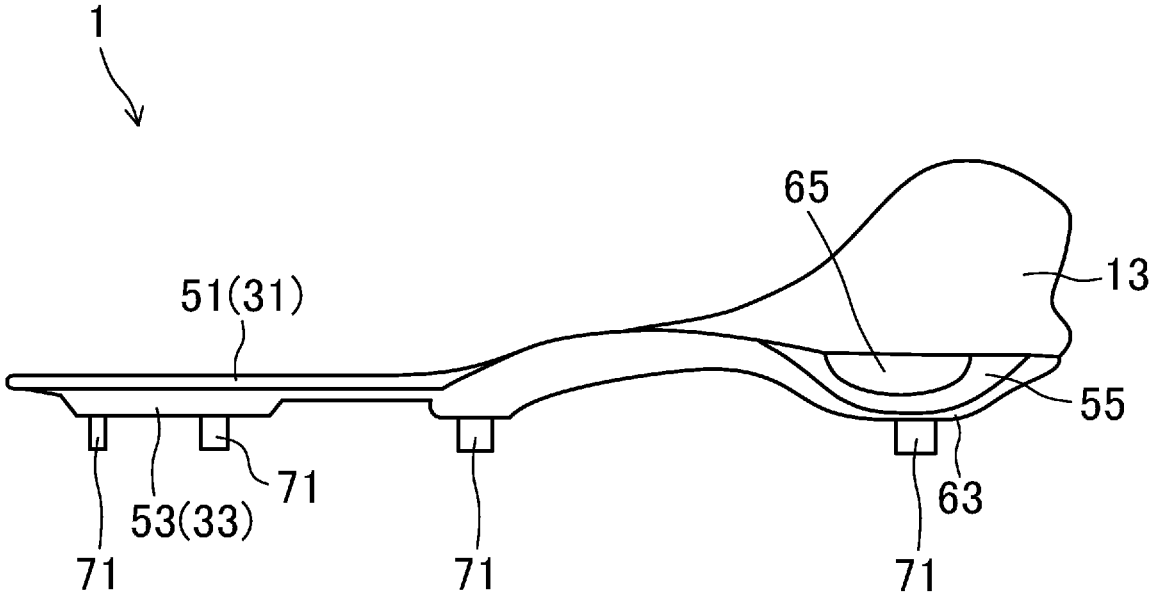
FIG. 12 corresponds to FIG. 2, and illustrates a sole structure according to a third embodiment of the present disclosure.

FIG. 12 illustrates a sole structure 1 according to a third embodiment of the present disclosure. The third embodiment differs from the first embodiment in part of the structure of the support 5.

The sole structure 1 according to the third embodiment is suitable to cleated shoes for sports such as soccer, rugby, American football, and baseball.

In the third embodiment, a sole body 3 is configured to function also as part of the support 5. Specifically, an upper plate 51 forms a midsole 31. Further, a lower plate 53 forms an outsole 33. The lower plate 53 has a lower surface provided with a plurality of studs 71, 71 . . . . In this way, the support body 5 is provided on the sole body 3. In addition, in the third embodiment, one bulge 63 is provided.

Note that the present disclosure is not limited to the embodiments described above, and various changes and modifications may be made without departing from the scope of the present disclosure.

The present disclosure is industrially applicable to, for example, walking shoes, running shoes, shoes for indoor sports, and shoes for ball sports played on soil or turf

What is claimed is:

1. A sole structure for a shoe, the sole structure comprising a sole body, wherein a support is provided to a heel area of the sole body, the heel area supporting a heel of a wearer of the shoe, the support includes:

an upper plate configured to support a foot of the wearer;

a lower plate provided below the upper plate; and a buffer member which is elastically deformable, provided between the upper plate and the lower plate, and has a lower Young's modulus than the upper plate and the lower plate, the lower plate includes a plurality of bulges, each of which is elastically deformable, and a bottom of each of which protrudes downward, the plurality of bulges forming a corrugated shape including upwardly curved portions and downwardly curved portions alternately arranged in a longitudinal direction of the shoe, the buffer member is disposed to extend along an outer peripheral edge of the heel area, the outer peripheral edge of the heel area corresponding at least to both of a medial side and a lateral side of the wearer of the shoe, the buffer member covering, from above, the plurality of bulges entirely in the longitudinal direction of the shoe, the buffer member includes a plurality of deformation spaces provided above each of the plurality of bulges and extending through the buffer member in a direction perpendicular to a thickness direction of the sole body, each of the plurality of deformation spaces being a hollow or in a shape of a recess, and the support is configured such that the plurality of bulges are allowed to elastically deform toward the plurality of deformation spaces due to the plurality of deformation spaces when the plurality of deformation spaces are in an open state, and that when the plurality of deformation spaces are in a closed state, the plurality of bulges are allowed to elastically deform upward and the buffer member provided above the plurality of bulges is compressively deformed while being sandwiched between the upper plate and each of the plurality of bulges.

2. The sole structure of claim 1, wherein the upper plate includes a lifting portion formed at each of both ends of the upper plate in the foot width direction, and extending upward.

3. A shoe comprising the sole structure of claim 1.

4. A shoe comprising the sole structure of claim 2.

* * * * *